US006015003A

United States Patent [19]

Switzgable

[11] Patent Number: 6,015,003

[45] Date of Patent: Jan. 18, 2000

[54] SECTIONAL OVERHEAD DOOR CONSTRUCTION

[76] Inventor: Harold Switzgable, 5 Linden La., So., Plainsboro, N.J. 08536

[21] Appl. No.: 09/065,381

[22] Filed: Apr. 23, 1998

[51] Int. Cl.[7] ..... E05D 15/06

[52] U.S. Cl. ..... 160/201; 160/228; 160/229.1; 160/235; 16/355; 24/587

[58] Field of Search ..... 160/201, 202, 160/211, 217, 222, 228, 229.1, 235; 16/355, DIG. 13; 24/587

[56] References Cited

U.S. PATENT DOCUMENTS

| | | | |
|---|---|---|---|
| 1,912,817 | 6/1933 | Bauer | 160/229.1 X |
| 2,070,557 | 2/1937 | Bantel . | |
| 2,093,020 | 9/1937 | Norberg . | |
| 2,300,265 | 10/1942 | Siess | 160/229.1 X |
| 2,352,892 | 7/1944 | Greulich | 160/229.1 X |
| 2,525,309 | 10/1950 | Norberg . | |
| 2,645,807 | 7/1953 | McKee et al. . | |
| 2,883,697 | 4/1959 | Stroup . | |
| 2,902,087 | 9/1959 | Stroup . | |
| 3,008,175 | 11/1961 | Biedinger et al. . | |
| 3,060,491 | 10/1962 | Pemberton et al. . | |
| 3,102,583 | 9/1963 | Rowe et al. . | |
| 3,218,037 | 11/1965 | Corley | 160/229.1 X |
| 3,376,913 | 4/1968 | Clapsaddle | 160/201 |
| 3,485,287 | 12/1969 | Milbourne, Sr. | 160/235 |
| 4,205,713 | 6/1980 | Galbreath | 160/201 |
| 4,718,472 | 1/1988 | Hörmann . | |
| 4,749,018 | 6/1988 | Alten . | |
| 4,793,397 | 12/1988 | Whiteman . | |
| 4,930,561 | 6/1990 | Clay . | |
| 4,995,441 | 2/1991 | Leist et al. . | |
| 5,002,114 | 3/1991 | Hörmann . | |
| 5,133,108 | 7/1992 | Esnault . | |
| 5,148,850 | 9/1992 | Urbanick . | |
| 5,168,914 | 12/1992 | Keller . | |
| 5,211,502 | 5/1993 | Upham-Hill | 160/229.1 X |
| 5,220,951 | 6/1993 | Dagenais . | |
| 5,235,724 | 8/1993 | Perrin et al. . | |
| 5,267,597 | 12/1993 | Green . | |
| 5,353,473 | 10/1994 | Sherick . | |
| 5,365,993 | 11/1994 | Jellá . | |
| 5,409,051 | 4/1995 | Mullet et al. . | |
| 5,445,206 | 8/1995 | Shepard . | |
| 5,474,118 | 12/1995 | Hoffman | 160/235 |
| 5,564,164 | 10/1996 | Jellá . | |
| 5,611,383 | 3/1997 | Hoffman | 160/235 X |
| 5,737,802 | 4/1998 | Jella | 160/201 X |

*Primary Examiner*—Daniel P. Stodola
*Assistant Examiner*—Bruce A. Lev
*Attorney, Agent, or Firm*—Sperry, Zoda & Kane

[57] ABSTRACT

A sectional overhead door construction utilizing articulated panels with a unique pinch-free interlocking system for connecting the lower edge of the panel with the upper edge of the panel therebelow utilizing a slotted configuration for greatly facilitating and expediting assembly. In preferred embodiments the panels will define an engagement finger positionable within an insertion slot or enlarged keyhole section of an adjacent panel. Movement of the engagement finger along the insertion slot will achieve placement thereof within an engagement slot which allows pivotal articulated relative movement between vertically adjacent sectional door panels within the articulated door panel apparatus.

20 Claims, 3 Drawing Sheets

SECTIONAL OVERHEAD DOOR CONSTRUCTION

BACKGROUND OF THE INVENTION

1. Field of the Invention

The present invention deals with the field of sectional overhead door constructions which preferably use a plurality of individual panels connected in an articulated manner such as to be pivotal with respect to one another and to facilitate storage of the sectional overhead door in a horizontal orientation above the vertical orientation when the door is closed.

In order to achieve movement capability a means must be included for maintaining the individual sectional door panels immediately adjacent to one another while at the same time allowing pivoted articulated movement relative to one another. It is preferable that this pivotal movement be achieved in a pinch-free manner to prevent dangers to users and operators of such doors.

2. Description of the Prior Art

There are many prior art devices for providing hinges and door panel configurations and interlocking means for forming articulated sectional overhead door designs such as U.S. Pat. No. 2,070,557 patented Feb. 16, 1937 to H. H. Bartel and assigned to Huck-Gerhardt Company, Inc. on a "Hinge Structure"; and U.S. Pat. No. 2,093,020 patented Sep. 14, 1937 to W. A. Norberg and assigned to Rowe Manufacturing Company on an "Overhead Door Construction"; and U.S. Pat. No. 2,525,309 patented Oct. 10, 1950 to W. A. Norberg and assigned to Raynor Manufacturing Company on a "Guide Roller And Hinge Structure"; and U.S. Pat. No. 2,645,807 patented Jul. 21, 1953 to J. F. McKee et al and assigned to McKee Door Company on a "Hinge For Multisection Overhead Doors"; and U.S. Pat. No. 2,883,697 patented Apr. 28, 1959 to E. L. Stroup and assigned to Overhead Door Corporation on a "Hinge And Track Engaging Roller Support For Slidable Closures"; and U.S. Pat. No. 2,902,087 patented Sep. 1, 1959 to E. L. Stroup and assigned to Overhead Door Corporation on "Hinges And Track Engaging Roller Supports For Slidable Closures"; and U.S. Pat. No. 3,008,175 patented Nov. 14, 1961 to H. J. Biedinger et al and assigned to Syracuse Stamping Company, Inc. on a "Hinge"; and U.S. Pat. No. 3,060,491 patented Oct. 30, 1962 to P. E. Pemberton et al and assigned to Overhead Door Corporation on a "Hinge And Track Engaging Roller Support For Slidable Closures"; and U.S. Pat. No. 3,102,583 patented Sep. 3, 1963 to D. H. Rowe et al and assigned to Rowe Manufacturing Company on a "Combined Hinge And Track Roller Supporting Structure"; and U.S. Pat. No. 3,376,913 patented Apr. 9, 1968 to V. E. Clapsaddle and assigned to Kinnear Corporation on a "Hinge And Roller Carrier Assembly"; and U.S. Pat. No. 4,718,472 patented Jan. 12, 1988 to M. Hormann and assigned to Hormann KG Amshausen on a "Sectional Strip For Roll-Up, Fold-Up, And Similar Gates"; and U.S. Pat. No. 4,749,018 patented Jun. 7, 1988 to K. Alten on a "Sectional Door For Buildings And The Like"; and U.S. Pat. No. 4,793,397 patented Dec. 27, 1988 to P. Whiteman and assigned to Morgan Corporation on a "Door And Hinge Construction For Overhead Doors"; and U.S. Pat. No. 4,930,561 patented Jun. 5, 1990 to R. Clay and assigned to Whiting Roll-up Door Mfg. Corp. on a "Roll-Up Door Joint Construction"; and U.S. Pat. No. 4,995,441 patented Feb. 26, 1991 to A. Leist et al on "Sectional Doors And Flexible Hinge Assemblies"; and U.S. Pat. No. 5,002,114 patented Mar. 26, 1991 to T. Hormann and assigned to Hormann KG Brockhagen on an "Overhead Door"; and U.S. Pat. No. 5,133,108 patented Jul. 28, 1992 to P. Esnault and assigned to FTFM la Toulousaine on a "Panel Articulation System"; and U.S. Pat. No. 5,148,850 patented Sep. 22, 1992 to B. Urbanick and assigned to Paneltech Ltd. on a "Weatherproof Continuous Hinge Connector For Articulated Vehicular Overhead Doors"; and U.S. Pat. No. 5,168,914 patented Dec. 8, 1992 to D. Keller and assigned to Hi-Fold Door Corporation on an "Automatic Jamb Latch Mechanism For Overhead Bifold Door"; and U.S. Pat. No. 5,220,951 patented Jun. 22, 1993 to R. Dagenais on a "Hinge Construction For A Folding Closure Assembly"; and U.S. Pat. No. 5,235,724 patented Aug. 17, 1993 to D. Perrin et al on a "Roller-Hinge Assembly For Retractable Overhead Door"; and U.S. Pat. No. 5,267,597 patented Dec. 7, 1993 to J. Green on a "Garage Door Apparatus"; and U.S. Pat. No. 5,353,473 patented Oct. 11, 1994 to T. Sherick on a "Bottom Fixture For Overhead Garage Doors"; and U.S. Pat. No. 5,365,993 patented Nov. 22, 1994 to J. Jellá on a "Sectional Door"; and U.S. Pat. No. 5,409,051 patented Apr. 25, 1995 to W. Mullet et al and assigned to Wayne-Dalton Corp. on a "Track System For Sectional Doors"; and U.S. Pat. No. 5,445,206 patented Aug. 29, 1995 to J. Shepard on "Flexible Closures Formed Of Interlocking Segments"; and U.S. Pat. No. 5,564,164 patented Oct. 15, 1996 to J. Jellá on a "Sectional Door Panel Hinge".

SUMMARY OF THE INVENTION

The present invention provides a sectional overhead apparatus which is easy to assemble and is made with an articulated panel apparatus. This apparatus includes multiple individual sectional door panels positioned adjacent one another preferably immediately above and below one another to form the overall door structure. The door is movable preferably between a vertically extending planar position and by articulation of the individual panels one at a time upwardly to a horizontally extending retracted position.

The individual sectional door panels of the articulated panel apparatus each include an exterior member facing outwardly and an interior member normally facing inwardly. The interior member is spatially disposed from the exterior member in such a manner as to define an interior space therebetween. This space provides an air pocket for insulation but also can receive specific insulating media such as fiberglass, foam or other stiffening and insulating materials.

The sectional door panel further includes a proximate side member extending between the exterior member and the interior member as well as a distal side member extending between the exterior member and the interior member at a position spatially disposed from the proximate side member. The proximate side member and the distal side member generally extend vertically.

An upper horizontal member also extends between the exterior member and the interior member and between the proximate side member and the distal side member in such a manner as to further define the internal space therebetween. Preferably a lower horizontal member extends between the exterior member and the interior member at a position spatially disposed from the upper horizontal member. It is these horizontal members which preferably include the interlocking means for forming the articulated movement of the sectional overhead door construction.

In a preferred configuration at least two such sectional door panels will be included which can be defined herein as the first and second door panels each having corresponding parts as detailed above.

An interlocking hinged device is also included positioned adjacent to the first and second sectional door panels for providing pivotal movement therebetween. This interlocking hinge device preferably includes a hinge plate as well as a first bracket fixedly mounted to the first sectional door panel. It also includes a second bracket fixedly mounted to the second sectional door panel. A first pin is attached with respect to the first bracket and the hinge plate to allow relative pivotal movement therebetween to facilitate operation of the interlocking hinge. The first pin is fixedly secured to the hinge plate and is rotatably attached to the first bracket to facilitate pivotal movement of the first sectional door panel with respect to the second sectional door panel and to maintain alignment therebetween during relative movement thereof.

In a similar manner a second pin is attached with respect to the second bracket and hinge plate in order to allow relative pivotal movement therebetween to facilitate operation of the interlocking hinge. The second pin preferably is fixedly secured to the hinge plate and rotatably attached to the second bracket in order to facilitate pivotal movement of the first sectional door panel with respect to the second sectional door panel and to maintain alignment therebetween during relative movement thereof.

The sectional overhead door construction further includes a plurality of roller members each rotatably mounted with respect to one of the interlocking hinges and extending outwardly therefrom away from the articulated panel apparatus. A roller guide track is preferably fixedly mounted to environmental structure and is adapted to receive the roller members movably retained in position therein in order to be movable therealong to allow movement of the articulated panel apparatus with respect to the roller guide track for facilitating operation of the sectional overhead door construction.

A unique aspect of the present invention is the panel interlocking means which is operative to engage the first sectional door panel with respect to the second sectional door panel thereadjacent while allowing relative pivotal movement therebetween to facilitate articulated sectional opening and closing thereof.

This panel interlocking configuration preferably includes an engagement slot defined in the first sectional door panel adjacent the second sectional door panel and extending parallel with respect to the first and second exterior members. An insertion slot is also preferably included defined in the first sectional door panel adjacent the second sectional door panel and is positioned such that it intersects the engagement slot in communication therewith. The insertion slot preferably extends generally parallel with respect to the engagement slot.

The panel interlocking means preferably further includes an engagement finger mounted on the second sectional door panel and extending outwardly therefrom toward the first sectional door panel thereadjacent and being selectively engageable with respect to the insertion slot and the engagement slot to maintain pivotal interlocking attachment therebetween.

In one configuration the engagement slot means further comprises a tab means fixedly secured to the first lower horizonal member and extending downwardly therefrom to facilitate engagement thereof within the insertion slot means and the engagement slot therebelow. This engagement finger so configured is oriented in registration with the engagement slot to extend therewithin responsive to the first sectional door panel and a second sectional door panel being vertically aligned with respect to one another with the proximate side members and distal side members thereof in vertical alignment.

In another alternative configuration the panel interlocking means can include a stud means or rivet member as the configuration of the engagement finger. Preferably such stud means or rivet will include a circular outer rim edge which is tapered to facilitate movement thereof into the insertion slot during assembly. To further enhance assembly the insertion slot may preferably define an enlarged keyhole area to facilitate movement of the head area of the stud into the insertion slot. In such configurations the enlarged head area of the stud will be larger than the insertion slot thereby requiring the inclusion of the enlarged keyhole area to facilitate assembly of the articulated panel door configuration.

It is an object of the present invention to provide a sectional overhead door construction which is easy to assemble wherein edges of vertically oriented panels are in abutment with respect to one another and are pivotally attached with respect to one another by a finger and slot configuration.

It is an object of the present invention to provide a sectional overhead door construction which is easy to assemble wherein maintenance costs are minimized.

It is an object of the present invention to provide a sectional overhead door construction which is easy to assemble wherein down time is minimized.

It is an object of the present invention to provide a sectional overhead door construction which is easy to assemble wherein the number of moving parts is minimized.

It is an object of the present invention to provide a sectional overhead door construction which is easy to assemble wherein assembly is significantly expedited.

It is an object of the present invention to provide a sectional overhead door construction which is easy to assemble wherein articulated movement of a sectional door is achieved with a pinch-free movement.

It is an object of the present invention to provide a sectional overhead door construction which is easy to assemble wherein firm pivotally movable securement is maintained between adjacent panels with a fastener free interlocking means.

It is an object of the present invention to provide a sectional overhead door construction which is easy to assemble wherein an insertion slot is included connected to an engagement slot to facilitate installation.

It is an object of the present invention to provide a sectional overhead door construction which is easy to assemble wherein an enlarged keyhole area is defined within an insertion slot to further facilitate installation.

It is an object of the present invention to provide a sectional overhead door construction which is easy to assemble wherein a continuous hinge can be provided which is pinch free.

It is an object of the present invention to provide a sectional overhead door construction which is easy to assemble wherein use with rollformed steel sectional doors is made possible.

It is an object of the present invention to provide a sectional overhead door construction which is easy to assemble wherein use with conventional C-channel tracks is achieved.

It is an object of the present invention to provide a sectional overhead door construction which is easy to assemble wherein resistance against excessive wind load is achieved.

It is an object of the present invention to provide a sectional overhead door construction which is easy to assemble wherein sectional door panels can be easily assembled into pivotal articulated connection with respect to an existing door panel by sliding with the bottom edge thereof along the upper edge of the installed panel.

It is an object of the present invention to provide a sectional overhead door construction which is easy to assemble wherein conventional hinge configurations are utilized to maintain vertical registration of the sectional panels with respect to one another to maintain interconnection of the engagement fingers within the engagement slots thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
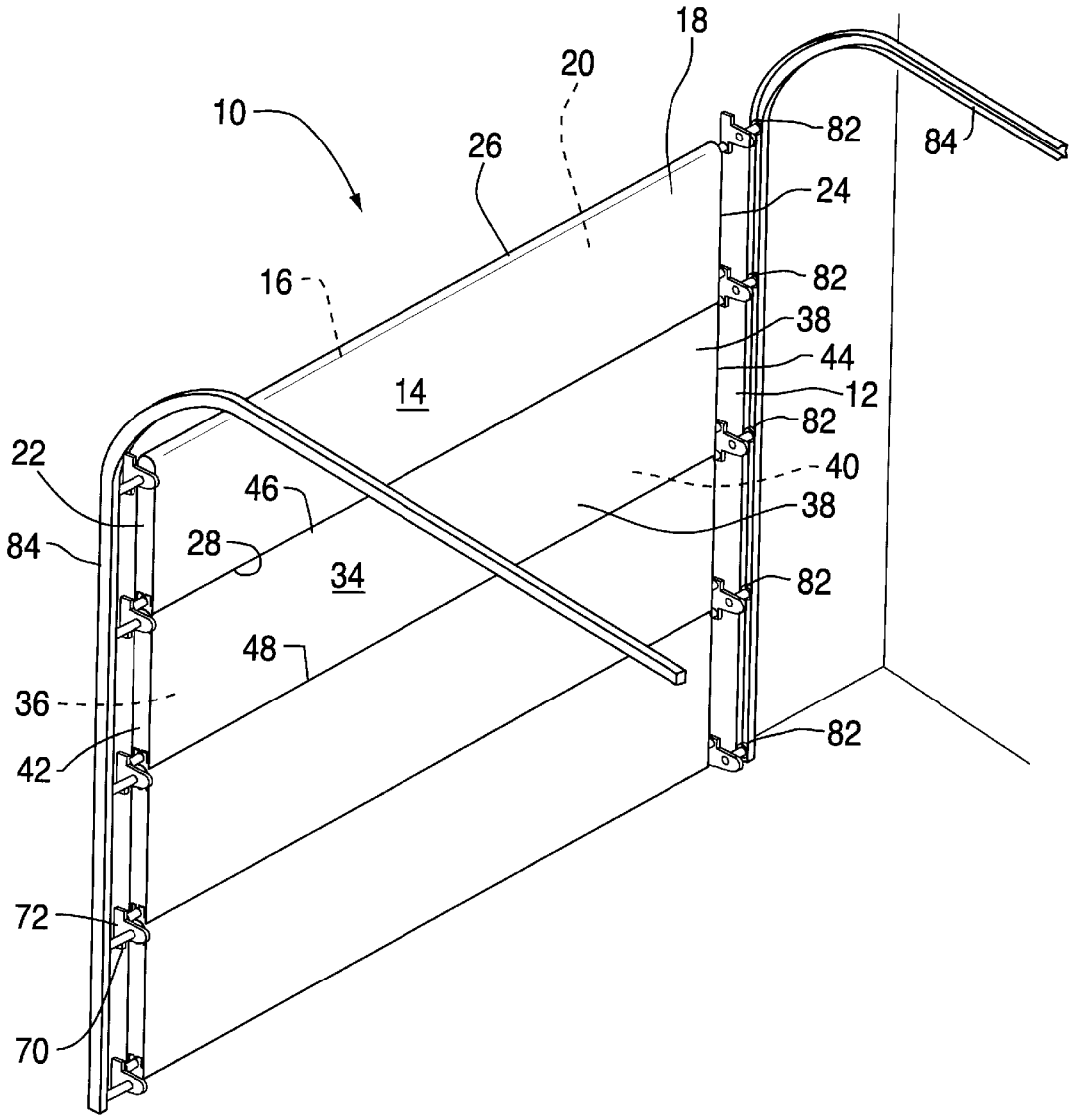
FIG. 1 is a rear perspective view of an illustration of the sectional overhead garage door made in accordance with the present invention.
Figure 2:
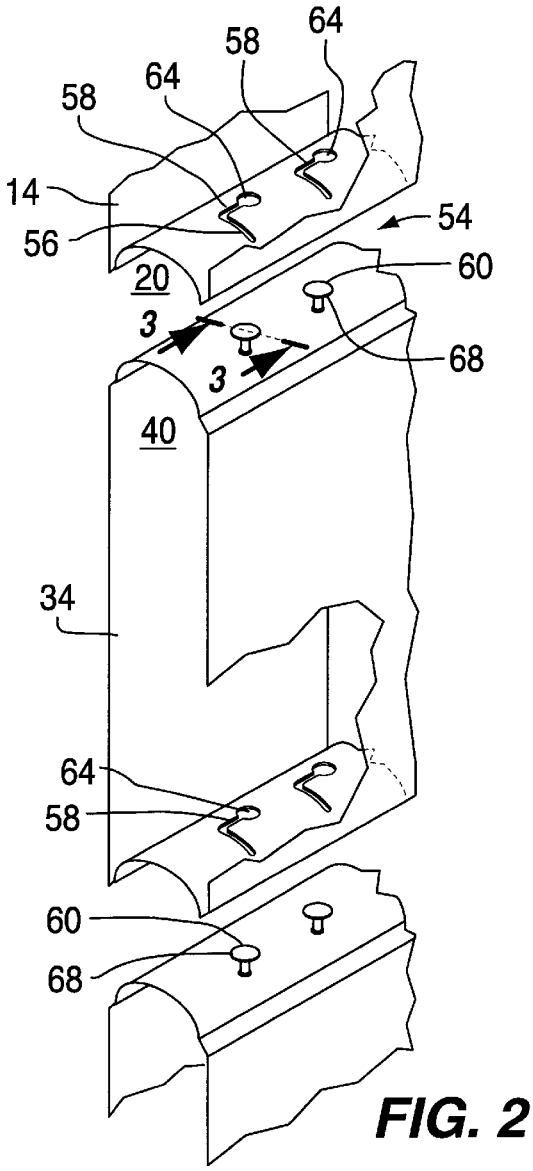
FIG. 2 is an assembly view of a panel interlocking means utilizing a stud and keyhole interlocking configuration.
Figure 3:
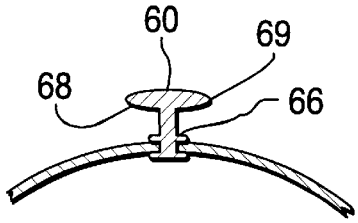
FIG. 3 is a side cross-sectional view of a rivet or stud used in accordance with the present invention.
Figure 4:
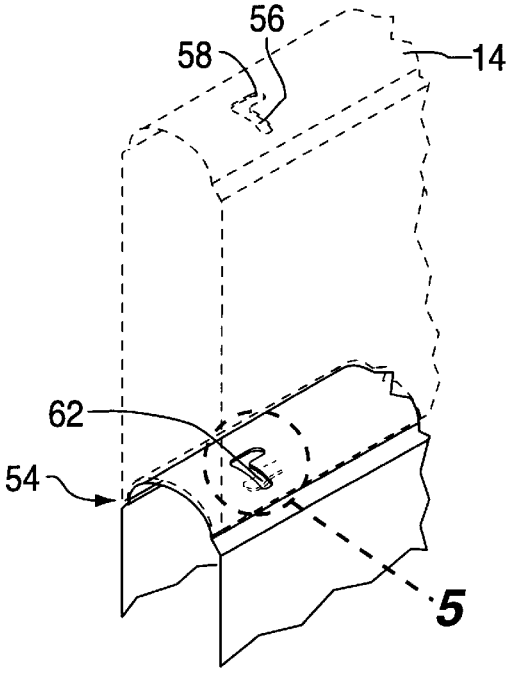
FIG. 4 is a side perspective illustration of an alternative embodiment of the panel interlocking means utilizing a tab and slot configuration.

The present invention provides a means for forming a sectional overhead door 10 formed from a plurality of individual sectional door panels such as a first sectional door panel 14 and the second sectional door panel 34 in such a manner as to form an articulated panel apparatus 12.

With this configuration the first sectional door panel 14 includes a first exterior surface or member 16 preferably facing outwardly from a defined enclosure. A first interior member 18 is parallel thereto and spaced from the first exterior member 16 to define a first internal space 20 therebetween. First internal space 20 can receive insulation or other material therein.

A first proximate side member 22 extends vertically along one end of the first sectional door panel 14 and a first distal side member 24 extends vertically along the opposite end remotely positioned from the first proximate side member 22.

A first upper horizontal member 26 extends horizontally between the upper ends of the first proximate side member 22 and the first distal side member 24. In a similar manner the first lower horizontal member 28 extends between the lower ends of said side members to enclose the internal space 20.

The unique configuration of the present invention is in the interconnection between adjacently positioned similarly configured sectional door panels 14. The configuration between each adjacent pair of interlocking panels will normally be complementary between one another. In a normal door configuration with four panels each pair will have the adjacent interlocking configuration defined herein. As such, in the drawings shown herein, a second sectional door panel 34 is included immediately below the first sectional door panel 14. In the preferred configuration, second sectional door panel 34 includes a second exterior member 36 and a second interior member 38 extending parallel with respect to one another and spaced apart to define an internal space 40 therebetween. Second internal space 40 can receive insulating material or stiffening material as desired.

The second sectional door panel 34 further includes a second proximate side member 42 and a second distal side member 44 extending vertically along opposite lateral sides of the second sectional door panel 34.

Similarly the second sectional door panel 34 includes a second upper horizontal member 46 extending horizontally along the upper edge of the second sectional door panel 34 between the side members. A second lower horizontal member 48 also extends between the lowermost end of the side members of the second sectional door panel 34. When in position as shown in FIG. 1, the first and second sectional door panels 14 and 34 will be positioned immediately above one another with the lower horizontal member of one in contact with the upper horizontal member of the other panel. The interlocking means of the present invention is designed for interconnecting these horizontally extending members to facilitate pivotal articulated movement of the multiple paneled sectional door configurations. Such doors can include two panels, three panels, four panels or more and more usually include three, four or five such panels. Of course for the purposes herein the operation of two adjacent panels will be described in detail.

The articulated panel apparatus, generally identified in the drawings as apparatus 12 of the present invention, preferably includes an interlocking hinge 70 which is designed to interconnect the outermost edges of adjacent panel members for maintaining vertical alignment therebetween. A first bracket means 74 is fixedly positioned within the internal space 20 of the first sectional door panel 14. In a similar manner the second bracket means 76 is positioned within the second internal space 40 of a second sectional door panel 34 adjacent the second proximate side member 42 thereof. A first pin means 78 will preferably be attached with respect to the hinge plate 72 and the first bracket 74 such as to allow pivotal movement between the first bracket 74 and the hinge plate 72 to facilitate articulated movement of adjacent panels with respect to one another while maintaining the proximate and distal side members thereof in vertical alignment. In a similar manner a second pin 80 is preferably oriented to be attached with respect to the hinge plate 72 and with respect to the second bracket 76 to allow pivotal movement of the second bracket 76 with respect to the hinge plate 72 for the above defined purposes.

Each hinge plate 72 will also include a roller member 82 rotatably mounted with respect thereto and extending outwardly away from the sectional overhead door 10. Roller members 82 are adapted to extend within a roller guide track means 84. Roller guide track means 84 guides the roller in movement through an arc which facilitates pivotal movement of the articulated panel apparatus 12 to move the door usually from a vertically extending planar orientation to a horizontally planar orientation for storage and vice versa.

A particularly unique aspect of the present invention is the configuration of the panel interlocking means 54. In the preferred configuration shown in these drawings, the panel interlocking means 54 defines an engagement slot 56 extending along the first lower horizontal member 28 of the first sectional door panel 14. An engagement finger 60 is included on the second upper horizontal member 46 and is adapted to selectively extend into the engagement slot 56 for maintaining adjacent positioning and alignment between the first sectional door panel 14 and the second sectional door panel 34 during articulated movement thereof between the vertically extending closed and the horizontally extending storage position.

Figure 5:
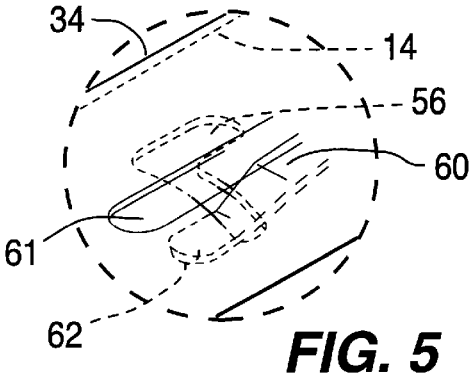
FIG. 5 is an exploded perspective illustration of the embodiment of the panel interlocking means shown in FIG. 4.
Figure 6:
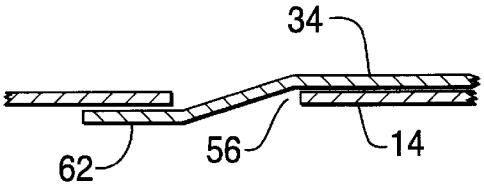
FIG. 6 is a cross-sectional view of the alternative embodiment shown in FIG. 4 with the engagement finger shown positioned within the engagement slot thereof.
Figure 7:
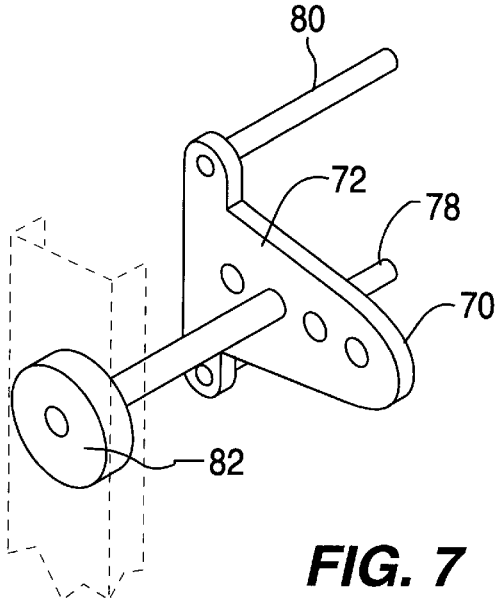
FIG. 7 is a side perspective illustration of an embodiment of an interlocking hinge made in accordance with the present invention.
Figure 9:
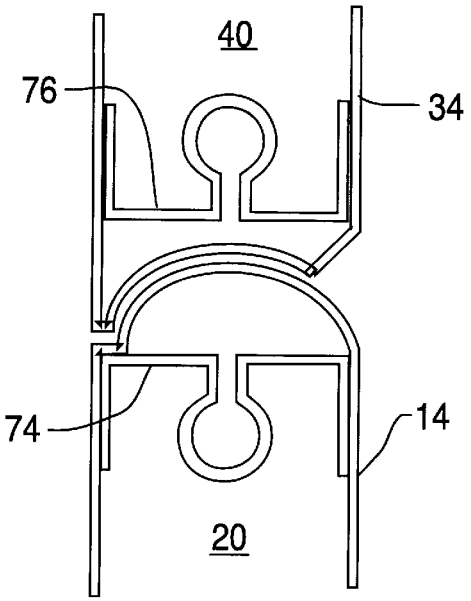
FIG. 9 is a side cross-sectional view of adjacently positioned first and second sectional door panels with the first and second bracket means positioned therein ready to receive hinge pins for placement of a hinge therein.
Figure 8:
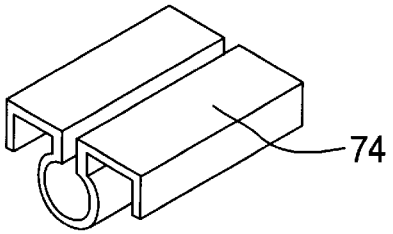
FIG. 8 is a side perspective illustration of a mounting bracket for the hinge pins of the present invention.
Figure 10:
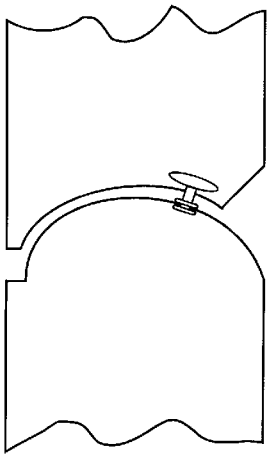
FIG. 10 is a side cross-sectional view showing adjacent sectional door panels interlocked with a stud member.
Figure 11:
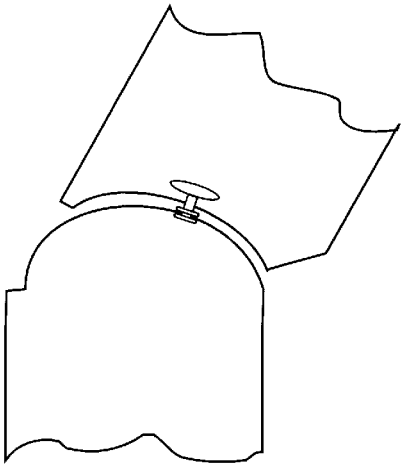
FIG. 11 is an illustration of the embodiment shown in FIG. 10 with the first sectional door panel pivoted for articulated movement of the sectional overhead door.

Preferably the first lower horizontal member 28 will also define an insertion slot means 58. In a preferred configuration the insertion slot means 58 will extend parallel to the exterior and interior members 16 and 18 to facilitate receiving of the engagement finger 60 therein. Preferably the engagement slot 56 will be perpendicular thereto in order to receive and retain the engagement finger 60 thereof and maintain alignment between the first sectional door panel 14 and the second sectional door panel 34 during articulated movement thereof between the opened and closed position. In a simple preferred configuration of the present invention the engagement finger preferably merely comprises a tab 62 extending outwardly from the second sectional door panel 34 in such a manner as to be adapted to engage the engagement slot 56. Preferably tab 62 is formed simply by punching thereof out of the material of the panel thereby leaving an opening 61 therein where the punched tab 62 is removed therefrom as seen best in FIG. 5.

In an alternative configuration, the engagement finger 60 comprises a stud member 66 such as a rivet or the like extending outwardly from the second sectional door panel 34. This rivet will preferably include an enlarged head second 68. With this configuration the insertion slot 58 will preferably include an enlarged keyhole area 64 to facilitate movement of the enlarged head section 68 of the stud 66 therein. To further facilitate movement of the enlarged head section 68 within the insertion slot 58 the head section may be configured with a tapered outer edge to form a circular outer rim 69 therealong which will significantly enhance the ability to find the enlarged keyhole area 64 by installation personnel removing the stud means 66 downwardly for preferable entry thereinto.

With this configuration the individual panels are assembled one at a time from above by moving the upper panel downwardly and slightly shifted to one side to allow entry of the engagement finger 60 into the insertion slot 58. Once this is achieved the upper sectional door panel is slid such that the side members thereof are immediately above the side members of the panel therebelow which simultaneously moves the engagement finger 60 into the engagement slot 56 to enhance articulated pivoting movement of these two sectional panels with respect to one another. This process is repeated until all panels of a given door are in place whether the number of panels is two, three, four, five, six or even greater. However, at least two panels will always be included in such an articulated overhead door construction. Once all the panels are in place the interlocking hinges 70 with the hinge plate 72 can be placed on the outer edges which will maintain vertical alignment between the side members of all of the individual sectional door panels and in this manner will maintain the engagement fingers 60 all within the respective associated engagement slots 56.

As such, with the configuration an easy to assemble and yet fully articulated pinch-free interconnecting system is provided between adjacent panels. This design is easy to assemble and very easy to achieve full installation within a very abbreviated period of time and provides an overall dependable and reliable pivotal engagement means in between adjacent panel sections.

It should be appreciated that the sole purpose of the enlarged keyhole area 64 is to provide an enlarged area within the insertion slot 58 for receiving the enlarged head section 68 of a stud or rivet member 66.

It is also preferably that the configuration of the horizontal members of both the first and second sectional door panels be concave and convex respectively. In a preferred configuration, the first upper horizontal member 26 and the second upper horizontal member 46 will both be convex whereas the first lower horizontal member 28 and the second lower horizontal member 48 will be concave. In this manner the adjacent edges will mate and facilitate pivotal movement without the possibility of creating dangerous pinching situations as is common when such abutting edges of sectional doors are flat rather than arcuate.

Also it should be appreciated that the configuration of the panel interlocking means 54 which utilizes a tab 62 selectively engageable with respect to the engagement slot 56 is particularly useful when used with rollformed steel sectional doors and can be easily fabricated from the material of which these doors are formed as they are so formed. For doors of different configurations and other forms it is preferable to use the configuration of the panel interlocking means 54 utilizing the rivet or stud 66 and the enlarged keyhole area 64 within the insertion slot 58.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A sectional overhead door and mounting construction comprising:

A. an articulated panel apparatus including a plurality of sectional door panels, said articulated panel apparatus including:

(1) a first sectional door panel including;

(a) a first exterior member;

(b) a first interior member spatially disposed from said first exterior member and defining a first internal space means therebetween;

(c) a first proximate side member extending between said first exterior member and said first interior member;

(d) a first distal side member extending between said first exterior member and said first interior member at a position spatially disposed from said first proximate side member and further defining said first internal space means therebetween;

(e) a first upper horizontal member extending between said first exterior member and said first interior member and between said first proximate side member and said second distal side member and further defining said first internal space means therebetween;

(f) a first lower horizontal member extending between said first exterior member and said first interior member at a position spatially disposed from said first upper horizontal member;

(2) a second sectional door panel including;

(a) a second exterior member;

(b) a second interior member spatially disposed from said second exterior member and defining a second internal space means therebetween;

(c) a second proximate side member extending between said second exterior member and said second interior member;

(d) a second distal side member extending between said second exterior member and said second interior member at a position spatially disposed from said second proximate side member and further defining said second internal space means therebetween;

(e) a second upper horizontal member extending between said second exterior member and said second interior member and between said second proximate side member and said second distal side member and further defining said second internal space means therebetween;

(f) a second lower horizontal member extending between said second exterior member and said second interior member at a position spatially disposed from said second upper horizontal member;

B. a panel interlocking means operative to engage said first sectional door panel with respect to said second sectional door panel thereadjacent while allowing relative pivotal movement therebetween to facilitate articulated sectional opening and closing thereof, said panel interlocking means comprising:

(1) an engagement slot defined within said first sectional door panel adjacent said second sectional door panel;

(2) an engagement finger mounted to said second sectional door panel and extending outwardly therefrom toward said first sectional door panel thereadjacent and being selectively engageable within said engagement slot of said first sectional door panel to maintain a pivotal interlocking attachment therebetween;

C. an interlocking hinge means positioned adjacent said first sectional door panel and said second sectional door panel for providing pivotal securement therebetween, said interlocking hinge means comprising:

(1) a hinge plate;

(2) a first bracket fixedly mounted to said first sectional door panel;

(3) a second bracket fixedly mounted to said second sectional door panel;

(4) a first pin means attached with respect to said first bracket and said hinge plate to allow relative pivotal movement therebetween to facilitate operation of said interlocking hinge means;

(5) a second pin means attached with respect to said second bracket and said hinge plate to allow relative pivotal movement therebetween to facilitate operation of said interlocking hinge means;

D. a plurality of roller members each rotatably mounted with respect to one of said interlocking hinge means and extending outwardly therefrom away from said articulated panel apparatus; and E. a roller guide track adapted to receive said roller members movably retained in position therein to be movable therealong to allow movement of said articulated panel apparatus for facilitating operating of said sectional overhead door construction.

2. A sectional overhead door and mounting construction as defined in claim 1 wherein said second sectional door panel is positioned immediately below said first sectional door panel with said first lower horizontal member immediately adjacent said second upper horizontal member to facilitate engagement therebetween by said panel interlocking means.

3. A sectional overhead door and mounting construction as defined in claim 2 wherein said first lower horizontal member of said first sectional door panel defines said engagement slot and wherein said engagement finger is mounted to said second upper horizontal member of said second sectional door panel to facilitate selective engagement of said engagement finger extending within said engagement slot.

4. A sectional overhead door and mounting construction as defined in claim 2 wherein said second lower horizontal member of said second sectional door panel defines said engagement slot and wherein said engagement finger is mounted to said first upper horizontal member of said first sectional door panel to facilitate selective engagement of said engagement finger extending within said engagement slot.

5. A sectional overhead door and mounting construction as defined in claim 2 wherein said first lower horizontal member is concave and wherein said second upper horizontal member is convex to facilitate abutment therebetween for allowing relative articulated pivotal movement between said first sectional door panel and said second sectional door panel.

6. A sectional overhead door and mounting construction as defined in claim 1 wherein said engagement slot is oriented extending generally perpendicularly to said first and second exterior members.

7. A sectional overhead door and mounting construction as defined in claim 6 wherein said first sectional door panel further defines an insertion slot intersecting said engagement slot in communication therewith and extending generally perpendicularly with respect thereto.

8. A sectional overhead door and mounting construction as defined in claim 7 wherein said engagement slot and said insertion slot are defined in said second upper horizontal member and wherein said engagement finger comprises a tab means fixedly secured to said first lower horizontal member and extending downwardly therefrom to facilitate engagement thereof within said insertion slot and said engagement slot.

9. A sectional overhead door and mounting construction as defined in claim 7 wherein said insertion slot includes an enlarged keyhole area to facilitate insertion of said engagement finger therewithin.

10. A sectional overhead door and mounting construction as defined in claim 9 wherein said engagement finger comprises a stud extending outwardly from said second sectional door panel.

11. A sectional overhead door and mounting construction as defined in claim 10 wherein said stud includes an enlarged head section larger than said insertion slot and said engagement slot and smaller than said enlarged keyhole area to facilitate entry thereof into said enlarged keyhole area and to facilitate retaining of said stud within said engagement slot during articulated movement during closing and opening of said sectional overhead door construction.

12. A sectional overhead door and mounting construction as defined in claim 11 wherein said enlarged head section is tapered outwardly to include a circular outer rim edge to facilitate insertion of said stud into said enlarged keyhole area and to facilitate retaining of said engagement finger within said engagement slot to facilitate articulated movement during closing and opening of said sectional overhead door construction.

13. A sectional overhead door and mounting construction as defined in claim 12 wherein said stud comprises a rivet.

14. A sectional overhead door and mounting construction as defined in claim 9 wherein said engagement slot, said insertion slot and said enlarged keyhole area are all defined within said first lower horizontal member immediately adjacent said second upper horizontal member.

15. A sectional overhead door and mounting construction as defined in claim 1 wherein said first pin means is fixedly secured to said hinge plate and rotatably attached to said first bracket to facilitate pivotal movement of said first sectional door panel with respect to said second sectional door panel and to maintain alignment therebetween during relative movement thereof.

16. A sectional overhead door and mounting construction as defined in claim 1 wherein said second pin means is fixedly secured to said hinge plate and rotatably attached to said second bracket to facilitate pivotal movement of said first sectional door panel with respect to said second sectional door panel and to maintain alignment therebetween during relative movement thereof.

17. A sectional overhead door and mounting construction as defined in claim 1 wherein said engagement finger is oriented in registration with said engagement slot to extend therewithin responsive to said first sectional door panel and said second sectional door panel being vertically aligned with respect to one another.

18. A sectional overhead door and mounting construction as defined in claim 17 wherein said first sectional door panel and said second sectional door panel are vertically aligned with respect to one another responsive to said first proximate side member and said second proximate side member being vertically aligned and responsive to said first distal side member and said second distal side member being also vertically aligned.

19. A sectional overhead door and mounting construction comprising:

A. an articulated panel apparatus including a plurality of sectional door panels, said articulated panel apparatus including:

(1) a first sectional door panel including;

(a) a first exterior member;

(b) a first interior member spatially disposed from said first exterior member and defining a first internal space means therebetween;

(c) a first proximate side member extending between said first exterior member and said first interior member;

(d) a first distal side member extending between said first exterior member and said first interior member at a position spatially disposed from said first proximate side member and further defining said first internal space means therebetween;

(e) a first upper horizontal member being generally convex in shape and extending between said first exterior member and said first interior member and between said first proximate side member and said second distal side member and further defining said first internal space means therebetween;

(f) a first lower horizontal member extending between said first exterior member and said first interior member at a position spatially disposed from said first upper horizontal member;

(2) a second sectional door panel positioned immediately above said first sectional door panel with said second lower horizontal member located immediately adjacent and above said first upper horizontal member, said second sectional door panel including;

(a) a second exterior member;

(b) a second interior member spatially disposed from said second exterior member and defining a second internal space means therebetween;

(c) a second proximate side member extending between said second exterior member and said second interior member;

(d) a second distal side member extending between said second exterior member and said second interior member at a position spatially disposed from said second proximate side member and further defining said second internal space means therebetween;

(e) a second upper horizontal member extending between said second exterior member and said second interior member and between said second proximate side member and said second distal side member and further defining said second internal space means therebetween;

(f) a second lower horizontal member being generally concave in shape and extending between said second exterior member and said second interior member at a position spatially disposed from said second upper horizontal member;

B. a panel interlocking means operative to engage said first sectional door panel with respect to said second sectional door panel thereadjacent while allowing relative pivotal movement therebetween to facilitate articulated sectional opening and closing thereof, said panel interlocking means comprising:

(1) an engagement slot defined within said first upper horizontal member of said first sectional door panel adjacent said second sectional door panel and extending generally perpendicularly with respect to said first and second exterior members;

(3) an insertion slot defined within said first upper horizontal member of said first sectional door panel adjacent said second sectional door panel and intersecting said engagement slot in communication therewith, said insertion slot extending generally perpendicularly with respect to said engagement slot;

(2) an engagement finger mounted to said second lower horizontal member of said second sectional door panel and extending outwardly and downwardly therefrom toward said first sectional door panel thereadjacent and being selectively engageable within said insertion slot and said engagement slot of said first sectional door panel to maintain a pivotal interlocking attachment therebetween, said engagement finger further comprising a tab means fixedly secured to said first lower horizontal member and extending downwardly therefrom to facilitate engagement thereof within said insertion slot and said engagement slot therebelow, said engagement finger being oriented in registration with said engagement slot to extend therewithin responsive to said first sectional door panel and said second sectional door panel being vertically aligned with respect to one another responsive to said first proximate side member and said second proximate side member being vertically aligned and responsive to said first distal side member and said second distal side member being also vertically aligned;

C. an interlocking hinge means positioned adjacent said first sectional door panel and said second sectional door panel for providing pivotal securement therebetween, said interlocking hinge means comprising:

(1) a hinge plate;

(2) a first bracket fixedly mounted to said first sectional door panel;

(3) a second bracket fixedly mounted to said second sectional door panel;

(4) a first pin means attached with respect to said first bracket and said hinge plate to allow relative pivotal movement therebetween to facilitate operation of said interlocking hinge means, said first pin means being fixedly secured to said hinge plate and rotatably attached to said first bracket to facilitate pivotal movement of said first sectional door panel with respect to said second sectional door panel and to maintain alignment therebetween during relative movement thereof;

(5) a second pin means attached with respect to said second bracket and said hinge plate to allow relative pivotal movement therebetween to facilitate operation of said interlocking hinge means, said second pin means being fixedly secured to said hinge plate and rotatably attached to said second bracket to facilitate pivotal movement of said first sectional door panel with respect to said second sectional door panel and to maintain alignment therebetween during relative movement thereof, D. a plurality of roller members each rotatably mounted with respect to one of said interlocking hinge means and extending outwardly therefrom away from said articulated panel apparatus; and E. a roller guide track adapted to receive said roller members movably retained in position therein to be movable therealong to allow movement of said articulated panel apparatus for facilitating operating of said sectional overhead door construction.

20. A sectional overhead door and mounting construction comprising:

A. an articulated panel apparatus including a plurality of sectional door panels, said articulated panel apparatus including:

(1) a first sectional door panel including;

(a) a first exterior member;

(b) a first interior member spatially disposed from said first exterior member and defining a first internal space means therebetween;

(c) a first proximate side member extending between said first exterior member and said first interior member;

(d) a first distal side member extending between said first exterior member and said first interior member at a position spatially disposed from said first proximate side member and further defining said first internal space means therebetween;

(e) a first upper horizontal member extending between said first exterior member and said first interior member and between said first proximate side member and said second distal side member and further defining said first internal space means therebetween;

(f) a first lower horizontal member being generally concave in shape and extending between said first exterior member and said first interior member at a position spatially disposed from said first upper horizontal member;

(2) a second sectional door panel positioned immediately below said first sectional door panel and said first lower horizontal member immediately adjacent and above said second upper horizontal member, said second sectional door panel including;

(a) a second exterior member;

(b) a second interior member spatially disposed from said second exterior member and defining a second internal space means therebetween;

(c) a second proximate side member extending between said second exterior member and said second interior member;

(d) a second distal side member extending between said second exterior member and said second interior member at a position spatially disposed from said second proximate side member and further defining said second internal space means therebetween;

(e) a second upper horizontal member being generally convex in shape and extending between said second exterior member and said second interior member and between said second proximate side member and said second distal side member and further defining said second internal space means therebetween;

(f) a second lower horizontal member extending between said second exterior member and said second interior member at a position spatially disposed from said second upper horizontal member;

B. a panel interlocking means operative to engage said first sectional door panel with respect to said second sectional door panel thereadjacent while allowing relative pivotal movement therebetween to facilitate articulated sectional opening and closing thereof, said panel interlocking means comprising:

(1) an engagement slot defined within said first lower horizontal member of said first sectional door panel adjacent said second sectional door panel and extending generally perpendicularly with respect to said first and second exterior members;

(3) an insertion slot defined within said first lower horizontal member of said first sectional door panel adjacent said second sectional door panel and intersecting said engagement slot in communication therewith, said insertion slot extending generally perpendicularly with respect to said engagement slot, said insertion slot defining an enlarged keyhole area to facilitate insertion therewithin;

(2) an engagement finger mounted to second upper horizontal member of said second sectional door panel and extending outwardly therefrom toward said first sectional door panel thereadjacent and being selectively engageable within said insertion slot and said engagement slot of said first sectional door panel to maintain a pivotal interlocking attachment therebetween, said engagement finger being oriented in registration with said engagement slot to extend therewithin responsive to said first sectional door panel and said second sectional door panel being vertically aligned with respect to one another responsive to said first proximate side member and said second proximate side member being vertically aligned and responsive to said first distal side member and said second distal side member being also vertically aligned, said engagement finger comprising a stud including an enlarged head section being larger than said insertion slot and said engagement slot and smaller than said enlarged keyhole area to facilitate entry thereof into said enlarged keyhole area and to facilitate retaining of said stud within said engagement slot during articulated movement during closing and opening of said sectional overhead door construction, said stud comprising a rivet means, said rivet means being tapered outwardly to include a circular outer rim edge to facilitate insertion of said stud into said enlarged keyhole area and to facilitate retaining of said engagement finger within said engagement slot to facilitate articulated movement during closing and opening of said sectional overhead door construction;

C. an interlocking hinge means positioned adjacent said first sectional door panel and said second sectional door panel for providing pivotal securement therebetween, said interlocking hinge means comprising:

(1) a hinge plate;

(2) a first bracket fixedly mounted to said first sectional door panel;

(3) a second bracket fixedly mounted to said second sectional door panel;

(4) a first pin means attached with respect to said first bracket and said hinge plate to allow relative pivotal movement therebetween to facilitate operation of said interlocking hinge means, said first pin means being fixedly secured to said hinge plate and rotatably attached to said first bracket to facilitate pivotal movement of said first sectional door panel with respect to said second sectional door panel and to maintain alignment therebetween during relative movement thereof;

(5) a second pin means attached with respect to said second bracket and said hinge plate to allow relative pivotal movement therebetween to facilitate operation of said interlocking hinge means, said second pin means being fixedly secured to said hinge plate and rotatably attached to said second bracket to facilitate pivotal movement of said first sectional door panel with respect to said second sectional door panel and to maintain alignment therebetween during relative movement thereof;

D. a plurality of roller members each rotatably mounted with respect to one of said interlocking hinge means and extending outwardly therefrom away from said articulated panel apparatus; and E. a roller guide track adapted to receive said roller members movably retained in position therein to be movable therealong to allow movement of said articulated panel apparatus for facilitating operating of said sectional overhead door construction.

* * * * *